US005886726A

United States Patent [19]

Pawelka et al.

[11] Patent Number: 5,886,726

[45] Date of Patent: Mar. 23, 1999

[54] THERMAL PRINT HEAD MODULE AND METHOD FOR USING

[75] Inventors: Gerhard Eduard-Franz Pawelka, Lexington; Jesse Erin Ambrosina, Somerville, both of Mass.; James M. Jordan, Eagan, Minn.

[73] Assignee: Datacard Corporation, Minneapolis, Minn.

[21] Appl. No.: 797,872

[22] Filed: Feb. 10, 1997

[51] Int. Cl.[6] ..... B41J 25/34; B41J 29/02

[52] U.S. Cl. ..... 347/197; 347/222; 347/49

[58] Field of Search ..... 347/222, 197, 347/49; 400/120.16, 120.17

[56] References Cited

U.S. PATENT DOCUMENTS

| | | | |
|---|---|---|---|
| 4,189,135 | 2/1980 | Costa . | |
| 4,594,597 | 6/1986 | Liu et al. . | |
| 4,619,197 | 10/1986 | Pailler . | |
| 4,932,798 | 6/1990 | Kardinal et al. . | |
| 5,296,874 | 3/1994 | Nagata et al. . | |
| 5,547,183 | 8/1996 | Tamura . | |
| 5,645,362 | 7/1997 | Aizawa et al. . | |
| 5,668,582 | 9/1997 | Manzone et al. | 347/49 |

FOREIGN PATENT DOCUMENTS

| | | |
|---|---|---|
| 4-197670 | 7/1992 | Japan . |

*Primary Examiner*—Huan Tran

*Attorney, Agent, or Firm*—Merchant, Gould, Smith, Edell, Welter & Schmidt, P.A.

[57] ABSTRACT

The present invention relates to a print module for use with a thermal printer. The print module includes a carriage including fastening structure for detachably fastening the carriage to the printer. The carriage is sized and shaped to receive print heads of various sizes and geometries from any number of manufacturers. A specific print head is mounted on the carriage along with a source of non-volatile memory. The source of non-volatile memory contains operational values characteristic of the specific print head. The operational values can be utilized by the printer to make operational adjustments that are customized with respect to the specific print head.

24 Claims, 6 Drawing Sheets

THERMAL PRINT HEAD MODULE AND METHOD FOR USING

FIELD OF THE INVENTION

The present invention relates generally to thermal printers for printing graphic images on substrates such as plastic cards.

BACKGROUND OF THE INVENTION

Thermal printers are used to print graphic images on substrates such as cards, webs, and other receptor materials. A typical thermal printer includes a thermal print head having a single column or row of dots. The dots are resistive elements that, when activated, heat a transfer ribbon and transfer thermally reactive inks or dyes from a carrier ribbon to a given substrate.

Current thermal print heads are prone to failure due to wear, particle contamination, and electrical degradation. The relatively short life-span of conventional thermal print heads means that print heads need to be replaced frequently. This is problematic because the design of conventional thermal printers makes it difficult to readily replace failed print heads. For example, to replace a failed print head, an end user is typically required to call a skilled technician to precisely align the new print head within the printer. The technician also typically replaces certain on-board electrical components of the thermal printer. Relying on a technician to replace failed print heads is expensive and time consuming.

Another obstacle to replacing failed print heads is that conventional thermal printers are each typically electronically and physically designed to operate with a single print head model. This presents problems if the particular model or type of print head needed by the end user is not available or if the end user is unhappy with the performance of his or her current print head. In such a situation, the end user can not readily substitute different models or brands of print heads within his or her printer. To provide such a substitution, the physical geometry and electronic configuration of the thermal printer must typically be radically changed to accommodate the new print head. There is a need in the art for thermal printers that address these problems and other problems.

SUMMARY OF THE INVENTION

One aspect of the present invention relates to a print module for use with a thermal printer. The print module includes a carriage including fastening structure for detachably fastening the carriage to the printer. The carriage is sized and shaped to receive print heads of various sizes and geometries from any number of manufacturers. A specific print head is mounted on the carriage along with a source of non-volatile memory. The source of non-volatile memory contains operational values characteristic of the specific print head. The operational values can be utilized by the printer to make operational adjustments that are customized with respect to the specific print head. The arrangement of the print module allows an end user to quickly and easily change print heads on the thermal printer without needing a technician. The arrangement also allows print heads of different sizes and shapes provided by any number of manufacturers to be readily used in the thermal printer without requiring physical changes to the print head or printer and without requiring customized on-board electronics of the printer to be replaced or substantially reconfigured.

Another aspect of the present invention relates to a thermal printer having a print module including a print head that is mounted on a readily detachable carriage. The carriage can be readily removed from the thermal printer to facilitate replacing the print head. The carriage preferably includes alignment structure, such as alignment pins, that function to precisely align the carriage at a printing location within the thermal printer. The carriage is sized to receive print heads of varying sizes and geometries, and includes adjustment structure for allowing a selected print head to be spatially adjusted and aligned with respect to the alignment structure of the carriage. The configuration of the printer and detachable print module allows print heads to be quickly and precisely interchanged without the aid of a technician.

A further aspect of the present invention relates to a printer having a pivotal swing arm on which a print head is mounted through the use of a detachable mounting carriage. The swing arm is moveable between an open configuration in which the carriage can be readily removed, and a closed position in which the print head is aligned to print cards or other substrates within the printer. The carriage is movable relative to the swing arm between first and second positions. A resilient structure is used to bias the carriage toward one of the two positions. The resilient structure allows the carriage to "float" relative to the swing arm to facilitate alignment of the carriage and to control contact pressure between the print head and a print ribbon during the printing process.

An additional aspect of the present invention relates to a method for aligning a print head within a printer, the printer having first and second alignment surfaces facing in substantially opposite directions. The method includes the step of providing a mounting carriage having a pair of alignment pins. Next, the print head is connected to the mounting carriage at specific location relative to the alignment pins. The mounting carriage is then positioned in the printer such that the alignment pins are aligned along a plane extending generally between the first and second alignment surfaces. The carriage is then moved to an aligned position by applying a moment to the carriage such that the first alignment pin is biased against the first alignment surface and the second alignment pin is biased against the second alignment surface. The aforementioned steps provide a method for achieving precise alignment of the print head without the need for precise tolerance control or precise bearing surfaces.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
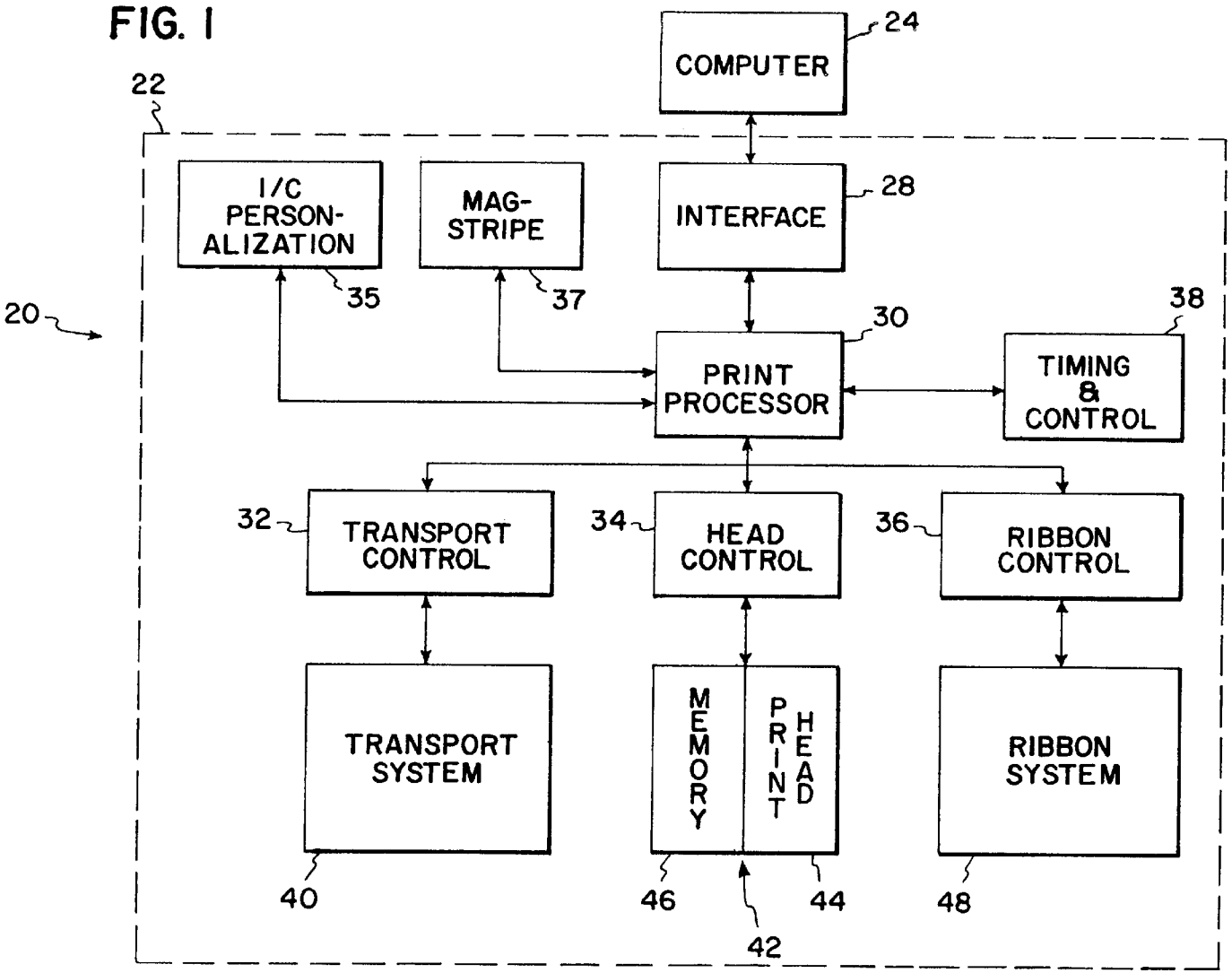
FIG. 1 is a block diagram of a thermal printer constructed in accordance with the principles of the present invention.

FIG. 1 is a block diagram illustrating a thermal printer 20 constructed in accordance with the principles of the present invention. Generally, the thermal printer 20 includes a print engine 22 for printing graphic images on receptor substrates, and a host computer 24 for providing the graphic images to the print engine 22. Data and commands are delivered between the print engine 22 and the computer 24 by an interface 28.

The print engine 22 includes a print processor 30 that controls the overall operation of the print engine 22. The print processor 30 interfaces with a transport controller 32, a head controller 34, and a ribbon controller 36. A timing and control processor 38 cooperates with the print processor 30 to coordinate and synchronize the operation of the transport controller 32, the head controller 34 and the ribbon controller 36. The print engine 22 also optionally includes an integrated circuit personalization interface 35 and a magnetic stripe personalization interface 37.

Through the transport controller 32, the print processor 30 controls a transport system 40 for moving substrates, such as cards, through the system. The transport system 40 preferably includes an arrangement of guide ramps, feed rollers, sensors, and stepper motors. The progress of a substrate through the system is monitored and controlled by the transport controller 32 via stepper motor signals and sensor signals from the transport system 40. Through the ribbon controller 36, the print processor 30 also controls a ribbon system 48 that includes a thermal transfer ribbon for transferring thermally reactive ink or dye to a given substrate such as a card.

The print engine 22 also includes a print module 42 having a thermal print head 44 and a source of non-volatile memory 46 such as a printed circuit board mounted adjacent to the print head 44. The print head 44 and the source of non-volatile memory 46 preferably comprise a package or module that can easily be removed from the system and replaced with a different package or module. The print head 44 preferably includes a row or column of dot elements. In one embodiment, the print head 44 includes 671 dot elements. The dot elements are resistive elements that, when activated, heat a transfer ribbon which causes a thermally reactive ink or dye to be transferred from a carrier ribbon to a desired location on a substrate. The operation of the print head 44 is controlled by print processor 30 through the head controller 34.

The non-volatile memory 46 of the print module 42 functions to store key operating characteristics and operating parameters of the print head 44. In one embodiment, the non-volatile memory is provided by a printed circuit board mounted in a carriage along with the print head 44. Exemplary types of information or values stored in the non-volatile memory 46 include the print head manufacturer and model, the print head date of manufacture, the dot resistance maximum, dot resistance minimum, the dot resistance average, a thermal constant representative of the rate in which the print head 44 dissipates heat, a constant representative of the base strobe duty cycle.

During power up, the print processor 30 reads the values from the non-volatile memory 46 and stores the values in working memory. The values are used during print operations to make operational adjustments that are customized with respect to the print head 44. For example, the thermal compensation constant is used in a thermal compensation algorithm which is used to control the energy supplied to the print head 44. Without the compensation algorithm, a solid color printed over the length of a card will be darker at the end of the card that is printed last due to the build up of heat in the print head 44 during the printing process. The algorithm needs a customized constant to effectively correct the problem. Such a customized constant is provided from the non-volatile memory 46.

Another exemplary customized value read from the non-volatile memory 46 of the print module 42 is the average resistance of the dot row. This value is used to adjust the base head voltage to get a consistent optical density.

Additionally, when a row of dots transitions from a majority on to a majority off, the print head 44 experiences a voltage shift resulting in a visible artifact being printed on the card. To correct the problem, the customized base strobe duty cycle value is used in an algorithm that is used to control the strobe duty cycle of the print head 44. Specifically, the duty cycle of the print head strobe signal is varied in an inverse relationship with respect to the number of dots on for a given dot row. The base duty cycle value read from the non-volatile memory 46 allows the algorithm to generate strobe duty cycle values that are customized with respect to the print head 44 such that the visible artifact problem is corrected.

In certain embodiments of the present invention, the printer 20 can include specialized data tables which are built into the printing machine's on-board read only memory. Each table contains operational values and data which are customized with respect to a specific model of print head provided by a specific manufacturer. The tables are designed to allow for the electrical adjustment necessary for proper operation of different print heads including print heads from different manufacturers. On power up, the firmware within the printer 20 queries the non-volatile memory 46 of the print module 42 as to the type of print head 44 and the key operating characteristic of the print head 44. These values are then used to select the proper table from within the printer's on-board, read only memory and to adjust certain operating parameters of the printer 20, such as base print head voltage and various compensation values.

The printer 20 can also maintain an operating history of the thermal print head 44. This is accomplished by having the printer 20 firmware write to the non-volatile memory 46 of the print module 42. Such operating information saved in the non-volatile memory can be used for warranty and service purposes.

Figure 2:
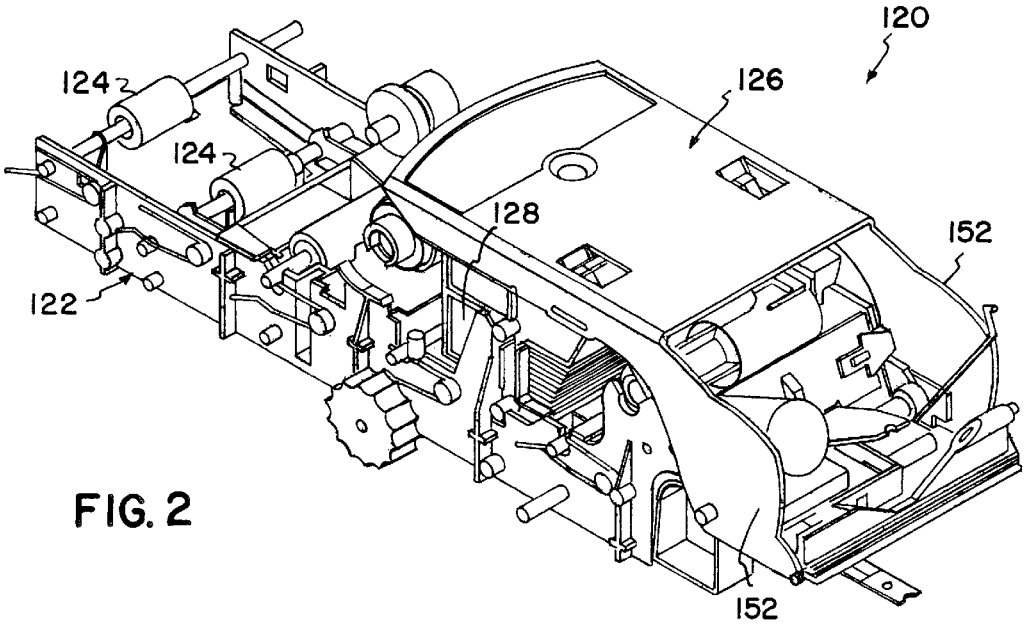
FIG. 2 is a perspective view of another thermal printer constructed in accordance with the principles of the present invention.
Figure 3:
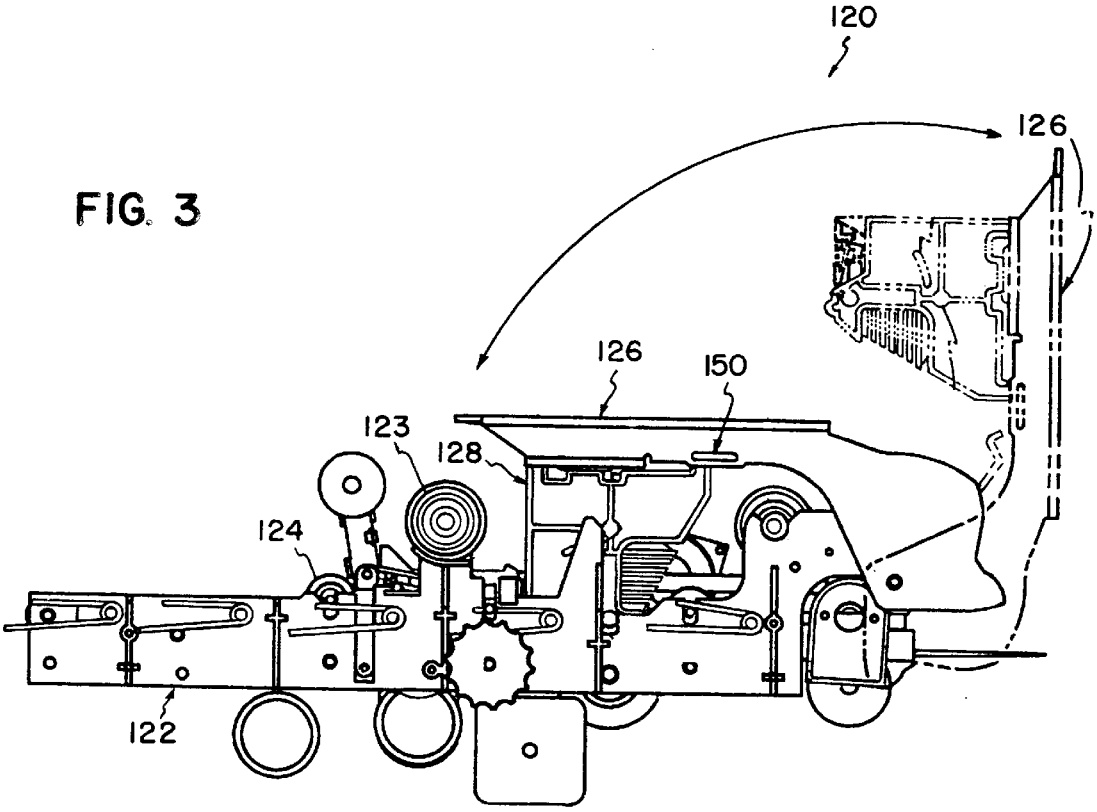
FIG. 3 is a side view of the printer of FIG. 2, a swing arm of the printer is shown in open and closed positions.

FIGS. 2 and 3 show another thermal printer 120 constructed in accordance with the principles of the present invention. The printer 120 includes a unitary, single piece chassis or frame 122 for supporting various components of the printer 120 such as print ribbon reels 123. The frame 122 defines a card pathway (shown via arrows on FIGS. 4 and 5) for guiding cards through the printer 120. A plurality of rollers 124 mounted on the frame 122 cooperate with sensors, a stepper motor, and a dc motor to control the position of a card within the printer 120. A swing arm 126 is pivotally connected to the frame 122. Detachably mounted on the swing arm 126 is print module including a carriage 128 in which a thermal print head 130, a printed circuit board 132 (shown in FIG. 6), and a heat sink 134 are mounted. As shown in FIG. 3, the swing arm 126 is pivotally moveable between an open position and a closed position. In the open position, there is sufficient clearance to allow the carriage 128 to be manually detached from the swing arm 126. In the closed position, the print head 130 is aligned at a precise location within the printing machine 120 so as to be adapted for printing graphic images on a selected card.

In basic operation, the swing arm 126 is manually moved from the open position to the closed position. Preferably, the swing arm 126 locks in place, by any number of conventionally known techniques, upon reaching the closed position. Once the swing arm is locked in place, a card is picked from an input hopper 136 (shown in FIGS. 4 and 5) and fed by the rollers 124 to a printing position located directly below the print head 130. After a graphic image has been printed on the card, the card is fed by the rollers 124 from the printing position to an output hopper 138 (shown in FIGS. 4 and 5). Next, a new card is picked from the input hopper 136 and the cycle is repeated.

When the print head 130 fails, the swing arm 126 is unlocked and moved from the closed position to the open position. Once the swing arm 126 is in the open position, the carriage 128 is detached from the swing arm 126. The end user then preferably replaces the old print module with a new print module including a new carriage, print head, heat sink, and printed circuit board. The new print head has preferably been factory aligned at a precise location within the new carriage. Consequently, the end user simply needs to fasten the new print module to the swing arm 126. The factory provided relative alignment between the new print head and the new carriage assures that the new print head will be properly aligned for printing a card within the print machine 120. Consequently, the end user can achieve precise alignment of the print head without needing the in-house assistance of a skilled technician.

It will be appreciated that printed circuit board 132 includes non-volatile memory in which operational values characteristic of the print head 130 are stored. During power up, the on-board firmware of the printing machine 120 reads the operational values from the printed circuit board 132 and uses the values to make operational adjustments which are customized with respect to the print head 130.

Figure 8:
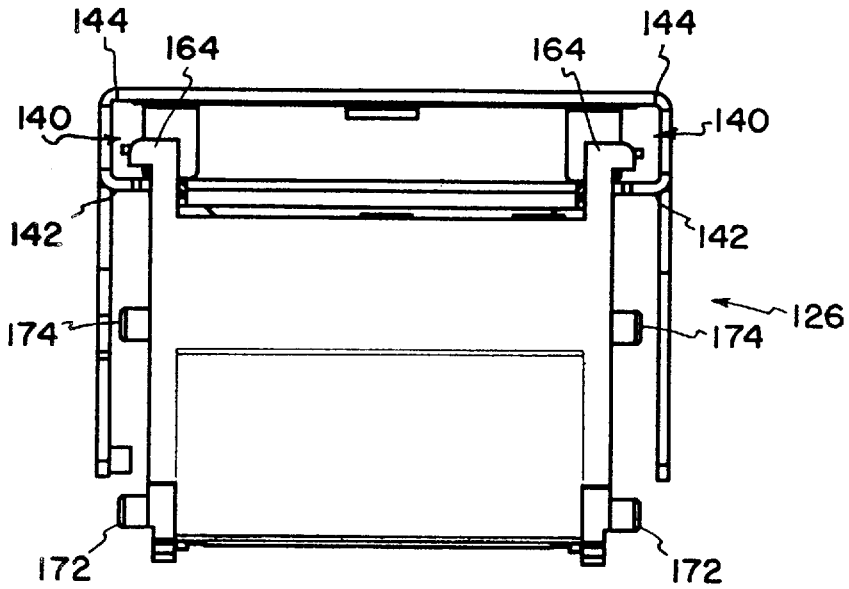
FIG. 8 is a left side view of the swing arm of FIG. 7.

The swing arm 126 of the printing machine 120 includes structure for detachably connecting the carriage 128 to the swing arm 126. For example, as shown in FIG. 8, a pair of mounting slots 140 are located adjacent the distal end of the swing arm 126. The mounting slots 140 are located on opposite sides of the swing arm 126. Each mounting slot 140 includes a first containment surface 142 spaced from an opposing second containment surface 144.

Figure 7:
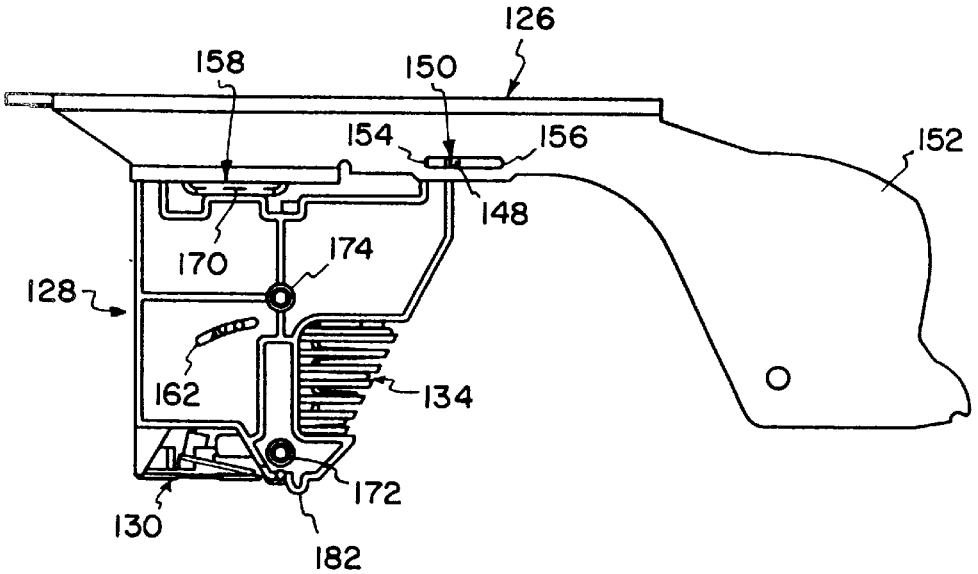
FIG. 7 is a side view of a swing arm utilized by the printer of FIG. 2.

As shown in FIG. 7, the swing arm 126 also includes a mounting pin 148 extending across the width of the swing arm 126. The ends of the mounting pin 148 are mounted in elongated slots 150 defined in side plates 152 of the swing arm 126. The elongated slots 150 extend lengthwise along the side plates 152 and have opposite first and second ends 154 and 156. A coil spring (not shown) biases the mounting pin 148 against the first ends 154 of the elongated slots 150. The swing arm 126 further includes a resilient structure 158 (best shown in FIG. 7) that projects transversely outward from the swing arm 126 at an intermediate location along the length of the swing arm 126. In certain embodiments, the resilient structure incorporates one or more spring structures such as coil springs or leaf springs.

Figure 6:
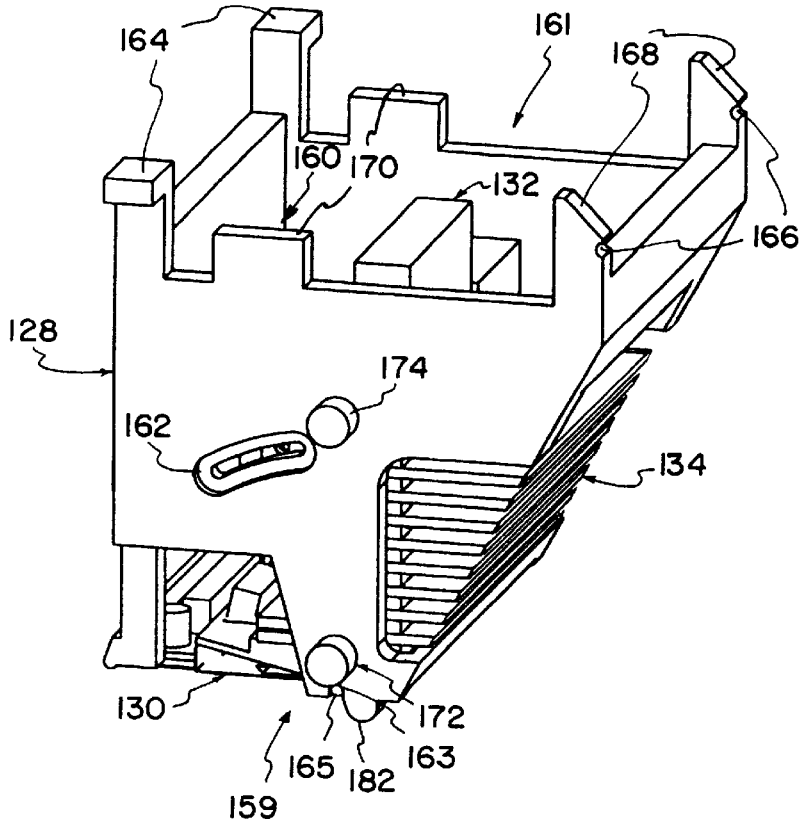
FIG. 6 is a perspective view of a print module utilized by the printer of FIG. 2.

As shown in FIG. 6, the carriage 128 of the printing machine 120 defines an inner chamber 160 sized to receive the print head 130, the heat sink 134 and the printed circuit board 132. The inner chamber 160 is preferably large enough to accommodate different types and physical sizes and geometries of print heads provided by different manufactures. Preferably, the print head 130 is secured to the heat sink 134 which is then mounted on the carriage 128. The printed circuit board 132 is then loaded with values characteristic of the print head 130 and mounted on the carriage 128 at a location generally adjacent to the print head 130. Referring to FIG. 6, the print head 130 is mounted adjacent to a first end 159 of the carriage 128. By contrast, electronic connectors (not shown) for electronically connecting the print head 130 and printed circuit board 132 to on-board control circuitry associated with the printer 120 are preferably mounted adjacent a second end 161 of the carriage 128.

The carriage 128 also includes structure for allowing the print head 130 to be spatially adjusted relative to the carriage 128. For example, curved adjustment slots 162 are defined by opposite sides of the carriage 120. Also, notches 163 are formed in the first end 159 of the carriage 128 generally below the slots 162.

In use, the print head 130 is connected at a precise location on the heat sink 134. Because print heads provided by different manufacturers have various sizes and shapes, heat sinks of various sizes and shapes are used in association with the present invention. Each particular heat sink shape corresponds to a particular manufacturer's print head. In essence, the heat sinks function as adapters for aligning the print head dot rows of different sized print heads at a precise location relative to the carriage 128.

Each of the various sizes and shapes of heat sink 134 includes threaded holes that correspond with the slots 162 of the carriage 128, and pivot pins 165 that fit within the notches 163 in the carriage 128. Set screws (not shown) preferably extend through the slots 162 and are threaded within the holes of the heat sink 134. When the set screws are loosened, the position of the heat sink 134 and print head 130 can be fine-tuned relative to the carriage 128 by pivoting the heat sink 134 about the pivots 165 such that the set screws slide along the adjustment slots 162. Once a precise alignment has been established between the print head 130 and the carriage 128, the set screws are tightened to lock the print head 130 in position.

As best shown in FIG. 6, the second end 161 of the carriage 128 includes structure for detachably connecting the carriage 128 to the swing arm 126. For example, the carriage 128 includes mounting tabs 164 that project laterally outward from opposite sides of the carriage 128. The mounting tabs 164 are constructed and arranged to fit within the mounting slots 140 defined adjacent the distal end of the swing arm 126. The second end 161 of the carriage 128 also includes pin slots 166 constructed and arranged to receive the mounting pin 148 of the swing arm 126. Ramp surfaces 168 are positioned directly adjacent to pin slots 166 for guiding the mounting pin 148 into the slots 166. The carriage 128 further includes torque pads 170 located on opposite sides of the carriage 128. The pads 170 project longitudinally outward from the second end 161 of the carriage 128 and are configured to be engaged by the resilient structure 158 of the swing arm 126 when the carriage 128 is mounted on the swing arm 126.

The carriage 128 is also equipped with structure for precisely aligning the carriage 128, and consequently the print head 130, with respect to the frame 122. For example, the carriage 128 includes two sets of first and second alignment pins 172 and 174 (shown in FIG. 8). The sets of first and second alignment pins 172 and 174 extend laterally outward from opposite sides of the carriage 128. The pins 172 and 174 have centers aligned substantially along a single alignment plane.

The print head 130 is mounted within the carriage 128 at a predetermined location relative to the alignment structure. For example, in one embodiment of the present invention, the print head 130 is positioned such that the print head dot row is located at the first end 159 of the carriage 130 and extends across the width of the carriage 128 in general alignment with the alignment plane defined by the sets of alignment pins 172 and 174.

The carriage 128 is connected to the swing arm 126 by inserting the mounting tabs 164 in the mounting slots 140. The distance between the first and second containment surfaces 142 and 144 is larger than the width of the mounting tabs 164. The variance in size between the mounting slots 140 and the mounting tabs 164 provides a "loose" mechanical connection that allows the carriage 128 to have a limited range of motion relative to the swing arm 126.

Once the mounting tabs 164 have been inserted in the mounting slots 140, the carriage 128 is pivoted toward the swing arm 126 such that the ramp surfaces 168 of the carriage 128 engage the mounting pin 148 of the swing arm 126. The ramp surfaces 168 force the mounting pin 148 downward along the elongated slots 150 and into the pin slots 166 of the carriage 128 such that the mounting pin 148 latches the carriage 128 to the swing arm 126. When the carriage 128 is latched to the swing arm 126, the resilient structure 158 of the swing arm 126 engages and is biased against the torque pads 170 of the carriage. In this manner, the resilient structure 158 is adapted to apply a moment (counterclockwise in FIG. 7) to the carriage 128 which causes the carriage 128 to pivot about the mounting pin 148 such that the mounting tabs 164 are biased toward the first containment surfaces 142 of the mounting slots 140. Similarly, the biasing springs of the mounting pin 148 cause the mounting pin 148 to apply a moment (counterclockwise in FIG. 7) to the carriage which complements the moment provided by the resilient structure and increases the net moment on the carriage 128. The limited range of carriage movement allowed by the mounting slots 140, combined with the resilient resistance to movement provided by the resilient structure 158 and the spring biased mounting pin 148, allows the carriage 128 to "float" relative to the swing arm 126.

Figure 9:
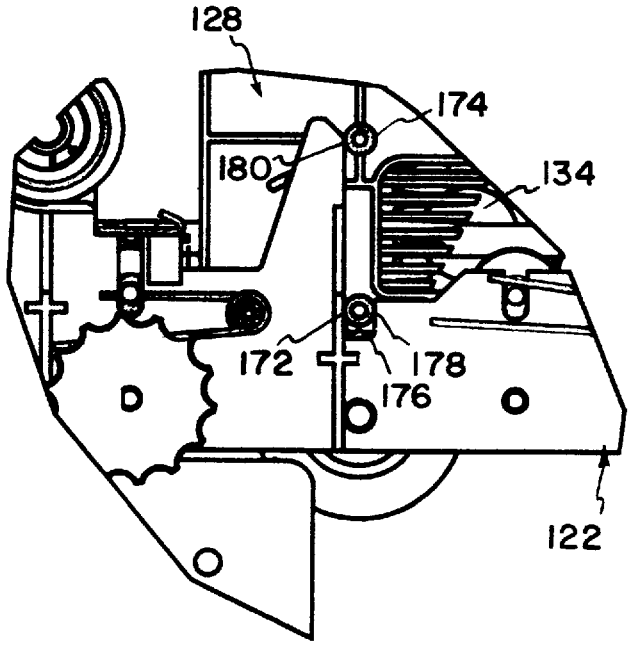
FIG. 9 is a detailed view of a portion of FIG. 3.

After the carriage 128 has been mounted on the swing arm 126, the swing arm 126 is moved from the open position to the closed position. The swing arm 126 reaches the closed position when the first alignment pins 172 are received in alignment slots 176 defined by opposite sides of the frame 122 (see FIG. 9 which is a detailed view of FIG. 3). The swing arm 126 is then locked in the closed position. When locked in the closed position, the torque provided by the resilient structure 158 biases the first alignment pins 172 against substantially vertical first alignment surfaces 178 extending upward along the alignment slots 176. Also, the second alignment pins 174 are biased against substantially vertical second alignment surfaces 180 positioned above the first alignment surfaces 178. It will be appreciated that the first and second alignment surfaces 178 and 180 face in substantially opposite directions. With the alignment pins 172 and 174 biased against the alignment surfaces 178 and 180, the alignment plane defined by the pins 172 and 174 extends substantially between the first and second alignment surfaces 178 and 180. The above-described biasing method insures precise alignment of the print head 130 relative to the frame 122.

Figure 4:
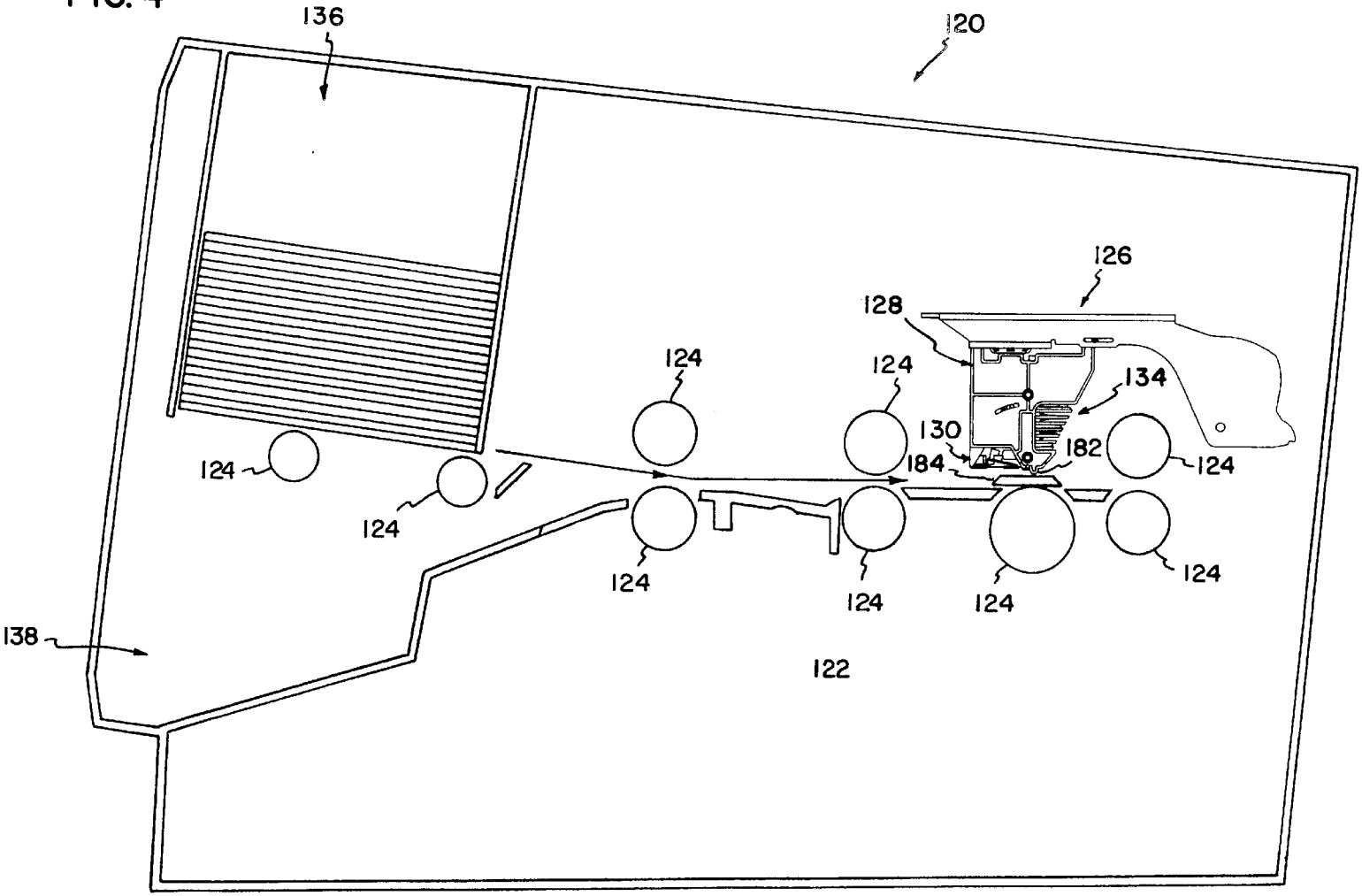
FIG. 4 is a schematic diagram illustrating an exemplary input path for the printer of FIG. 2.
Figure 5:
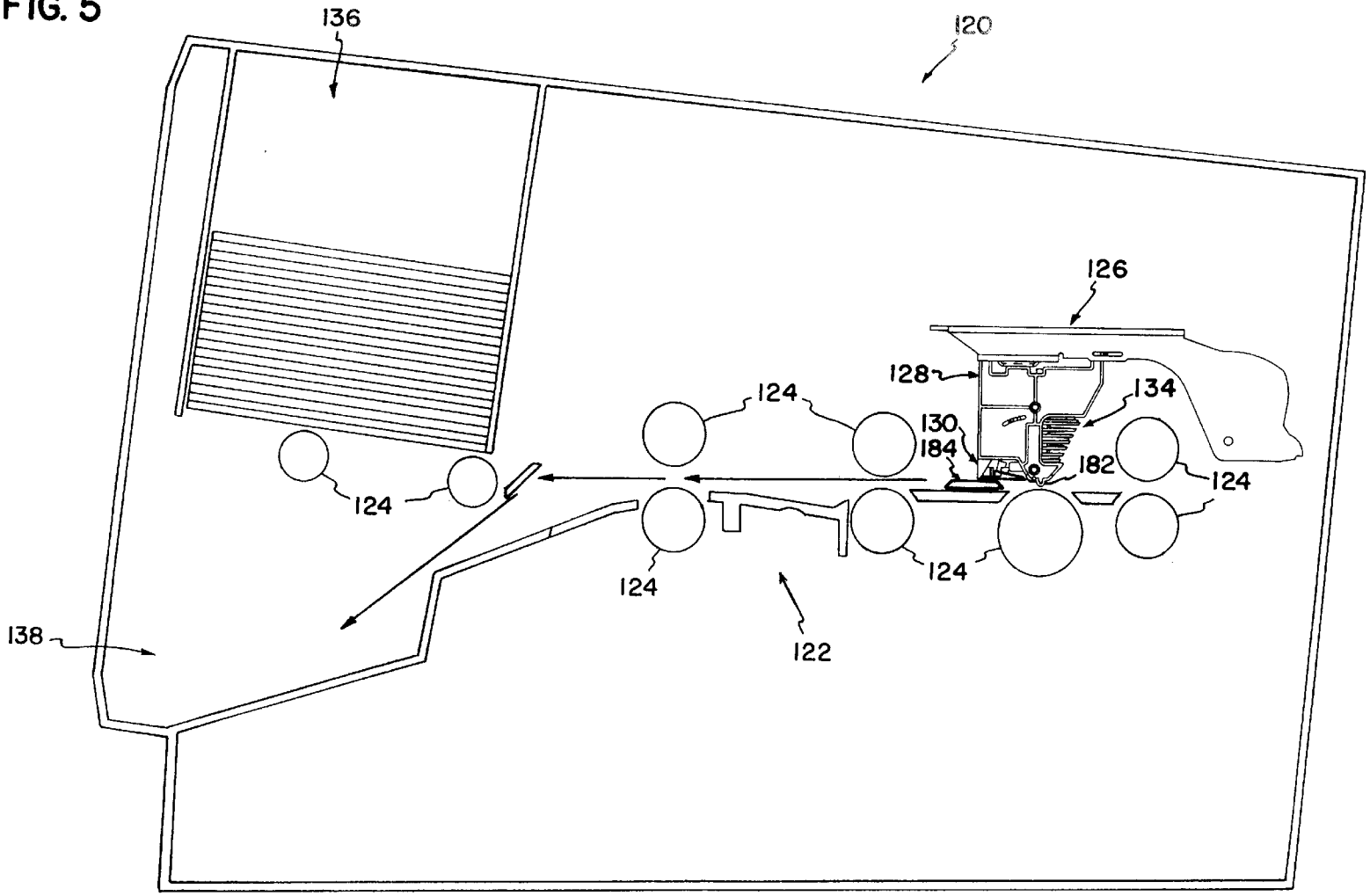
FIG. 5 is a schematic diagram illustrating an exemplary output path for the printer of FIG. 2.

As shown in FIGS. 4 and 5, the carriage 128 also includes follower members 182 projecting outward from the first end 159 of the carriage 128. When the swing arm 126 is in the closed position, the follower members 182 cooperate with slide cams 184 on the frame 122 to vertically move the carriage 128 relative to the frame 122. For example, when a card is to be fed under the print head 130, the slide cams 184 move beneath the follower members 182 thereby lifting the carriage 128 and print head 130 to provide clearance for the card. Once the card is beneath the print head 130, the slide cams 184 are retracted allowing the carriage 128 to move downward such that the print head 130 is pressed against the print ribbon and the top surface of the card for printing purposes. The printing pressure exerted by the print head 130 is controlled by the resilient structure 158 of the locking arm 126. After the card has been printed, the print head 130 is again lifted by the slide cams 184 such that the printed card can be removed and replaced with a subsequent card.

As shown in FIG. 7, the follower members 182 are positioned to the right of the moment axis of the carriage 128. Consequently, when the slide cams 184 contact the follower members 182, the lifting force generates a moment (counterclockwise as shown in FIG. 7) which complements the moments provided by the resilient structure 158 and the spring biased latch pin 148. Similarly, the dot row of the print head is preferably located on the same side of the carriage moment axis as the follower members 182. Consequently, contact between the dot row and the print ribbon as the print head 130 prints a card generates a moment (counterclockwise in FIG. 7) that complements the moments provided by the resilient structure 158 and the spring biased latch pin 148. Furthermore, it is preferred for the direction a card is moved during printing to be selected such that the frictional forces between the print head and the print ribbon create a moment on the carriage 128 which is also in a counterclockwise direction and which complements the aforementioned moments applied to the carriage 128. For example, in FIG. 7, the card and print ribbon would be moved from left to right during the preferred printing process.

It will be appreciated that the moments generated by the resilient member 158, the biased latch pin 148, the lift forces exerted on the follower members 182, lift forces exerted on the dot row by the print ribbon during printing of the card, and the frictional forces exerted on the carriage 128 during printing, are all in one uniform direction. The net moment applied to the carriage 128 biases the alignment pins 172 and 174 against the alignment surfaces 178 and 180 to maintain alignment of the print head 130.

Also, throughout the specification, the various embodiments have been described as being used in association with "cards". It will be appreciated that the term cards includes substrates of various sizes made of various materials such as plastic, paper coated with plastic, plastic/paper composites, and any other materials and composites thereof suitable for thermal printing. Furthermore, the various aspects of the present invention are not intended to be limited for use in printing cards. Instead, a variety of receptor substrates of any number of known materials or configurations can be thermally printed in accordance with the principles of the present invention.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A print module for use with a thermal printer, the print module comprising:

a carriage including fastening structure for detachably fastening the carriage to the printer, the carriage being sized and shaped to receive print heads of various sizes and geometries;

a specific print head mounted on the carriage; and a source of non-volatile memory mounted on the carriage, the source of non-volatile memory containing operational values characteristic of the specific print head, wherein the operational values can be utilized by the printer to make operational adjustments that are customized with respect to the specific print head.

2. The print module of claim 1, wherein the source of non-volatile memory includes a printed circuit board mounted on the carriage.

3. The print module of claim 1, wherein the specific print head is connected to a heat sink that is mounted on the carriage, the heat sink being constructed and arranged to align the specific print head at a predetermined location relative to the carriage.

4. The print module of claim 3, wherein the carriage includes adjustment structure for fine-tuning the position of the print head relative to the carriage.

5. The print module of claim 4, wherein the adjustment structure includes a pair of slots defined by opposite side walls of the carriage and fasteners extending through the slots for fastening the heat sink to the carriage, the print head position being adjustable relative to the carriage by sliding the heat sink along the slots.

6. The print module of claim 1, wherein the fastening structure of the carriage includes a pair of mounting members projecting laterally outward from the carriage, and a hook structure.

7. The print module of claim 6, further comprising the printer, wherein the printer includes a swing arm having mounting slots configured to receive the mounting members of the carriage, and a latch member configured to engage the hook structure of the carriage, wherein the mounting slots and the latch member cooperate with the fastening structure of the carriage to detachably connect the carriage to the swing arm.

8. The print module of claim 7, further comprising a resilient structure constructed and arranged to apply a moment to the carriage while the carriage is mounted on the swing arm.

9. The print module of claim 8, wherein the resilient structure is positioned between the carriage and the swing arm and projects transversely outward from an intermediate location on the swing arm.

10. The print module of claim 8, wherein the resilient structure includes the latch member, the latch member being biased against the carriage to generate the moment.

11. The print module of claim 1, further comprising the printer, the printer including a carriage mounting structure constructed to cooperate with the fastening structure of the carriage to detachably fasten the carriage to the printer, the carriage mounting structure including a resilient structure for applying a moment to the carriage.

12. The print module of claim 1, wherein the carriage includes first and second alignment members projecting laterally outward from one side of the carriage.

13. The print module of claim 1, wherein the carriage is fastened to the printer and the printer includes resilient structure for applying a moment to the carriage, wherein the moment provided by the resilient structure biases carriage toward an aligned position.

14. A printer for printing a substrate, the printer comprising:

a frame;

a swing arm pivotally connected to the frame, the swing arm being pivotally moveable between a printing position and a non-printing position;

a carriage connected to the swing arm, the carriage having a limited range of motion relative to the swing arm, the limited range of relative motion including movement between first and second positions, and the carriage being manually removable from the swing arm when the swing arm is in the non-printing position;

a print head mounted on the carriage and aligned such that when the swing arm is in the printing position, the print head is adapted for printing the substrate; and a resilient structure constructed and arranged to bias the carriage toward the first position.

15. The printer of claim 14, wherein the carriage includes a set of first and second alignment members projecting laterally outward from a side of the carriage.

16. The printer of claim 14, wherein the carriage includes two sets of first and second alignment pins, each set of alignment pins projecting laterally outward from opposite sides of the carriage and both sets of alignment pins being aligned substantially along a single alignment plane.

17. The printer of claim 15, wherein the frame defines an alignment slot configured to receive at least the first alignment pin of the carriage when the swing arm is moved to the printing position, the first alignment pin and the alignment slot cooperating to align the print head relative to the frame.

18. The printer of claim 15, wherein the frame includes a set of first and second alignment surfaces facing in substantially opposite directions, the alignment surfaces being arranged and configured such that when the swing arm is in the printing position, the resilient structure biases the first alignment member against the first alignment surface and the second alignment member against the second alignment surface to achieve alignment of the print head relative to the frame.

19. The printer of claim 16, wherein the frame includes two sets of first and second alignment surfaces, the first and second alignment surfaces facing in substantially opposite directions and being arranged and configured such that when the swing arm is in the printing position, the resilient structure biases the first alignment pins against the first alignment surfaces and the second alignment pins against the second alignment surfaces to achieve alignment of the print head relative to the frame.

20. A method for aligning a thermal print head within a thermal printer, the method comprising the steps of:

positioning the print head within the printer such that the print head is moveable between an aligned first position and a non-aligned second position; and applying a plurality of moments to the print head such that the print head is biased toward the aligned position wherein said plurality of moments are applied in the same direction to bias the print head toward the aligned position.

21. The method of claim 20, wherein one of said plurality of moments is provided via friction generated between the print head and a print ribbon during printing.

22. The method of claim 20, wherein one of said plurality of moments is provided via a resilient structure operatively connected to the printer.

23. The method of claim 20, wherein one of said plurality of moments is provided via a printing force generated as the print head engages a thermal print ribbon to print a substrate.

24. A method for aligning a thermal print head within a printing machine, the printing machine including first and second alignment surfaces facing in substantially opposite directions, the method comprising the steps of:

mounting the print head on a carriage having first and second alignment members aligned substantially along an alignment plane;

moving the carriage such that the alignment plane extends between the first and second alignment surfaces of the printing machine; and applying a moment to the carriage such that the first alignment member is pressed against the first alignment surface and the second alignment member is biased against the second alignment surface to achieve a desired alignment of the print head.

* * * * *